US008290422B2

(12) United States Patent
Nishimura

(10) Patent No.: US 8,290,422 B2
(45) **Date of Patent: *Oct. 16, 2012**

(54) IMAGE FORMING DEVICE

(75) Inventor: Jun Nishimura, Osaka (JP)

(73) Assignee: Kyocera Mita Corporation, Osaka (JP)

( * ) Notice: Subject to any disclaimer, the term of this patent is extended or adjusted under 35 U.S.C. 154(b) by 1101 days.

This patent is subject to a terminal disclaimer.

(21) Appl. No.: 12/228,402

(22) Filed: Aug. 11, 2008

(65) Prior Publication Data

US 2009/0060607 A1 Mar. 5, 2009

(30) Foreign Application Priority Data

Aug. 27, 2007 (JP) ..... 2007-220326

(51) Int. Cl.
*G03G 15/00* (2006.01)

(52) U.S. Cl. ..... 399/388; 399/46; 399/75; 399/76; 399/361; 399/391

(58) Field of Classification Search ..... 399/46, 399/75, 76, 361, 388, 391
See application file for complete search history.

(56) References Cited

U.S. PATENT DOCUMENTS 5,841,362 A * 11/1998 Nakamura et al. ..... 382/100
7,796,909 B2 * 9/2010 Nishimura ..... 399/75

FOREIGN PATENT DOCUMENTS

JP 2000-351252 12/2000

* cited by examiner

*Primary Examiner* — Matthew G Marini
*Assistant Examiner* — Andy Pham
(74) *Attorney, Agent, or Firm* — Jordan and Hamburg LLP

(57) ABSTRACT

A main body control part of an image forming device switches select signals to a unicast mode by a communication mode switching part at least when stopping a recording paper that is being transported on a paper feeding path or when transporting a recording paper stopped on the paper feeding path, and switches the select signals to the broadcast mode after transmitting control data. Each of the paper feeding control parts executes a paper feeding control based on the control data received with the unicast mode, upon detecting the broadcast mode.

7 Claims, 8 Drawing Sheets

| | Unicast mode (SL2,SL1,SL0) | | | | Broadcast mode (L2,SL1,SL0) | |
|---|---|---|---|---|---|---|
| Paper feeding control part where control data is directed | First-drawer 200a | Second-drawer 200b | Third-drawer 200c | Fourth-drawer 200d | All | All |
| Select signal transmitted from main-body side communication control device | 100 (A) | 110 (B) | 111 (C) | 011 (D) | 010 (F) | 101 (G) |
| Select signal received at paper feeding control part 200a | 100 (E) | 110 | 111 | 011 | 010 | 101 |
| Select signal received at paper feeding control part 200b | 000 | 100 (E) | 110 | 111 | 101 | 010 |
| Select signal received at paper feeding control part 200c | 001 | 000 | 100 (E) | 110 | 010 | 101 |
| Select signal received at paper feeding control part 200d | 011 | 001 | 000 | 100 (E) | 101 | 010 |

Fig.5

IMAGE FORMING DEVICE

This application is based on an application No. 2007-220326 filed in Japan, the contents of which are hereby incorporated by reference.

BACKGROUND OF THE INVENTION

1. Field of the Invention

The present invention relates to an image forming device which is structured in such a manner that a main body control part for controlling an image forming part is connected, via a serial communication line and a plurality of select signal lines for designating a transmission target, to a plurality of paper feeding control parts which individually control a plurality of paper feeding cassettes that supply recording papers to the image forming part, thereby allowing the main body control part to control communications with each of the paper feeding control parts with a polling system.

2. Description of the Related Art

Japanese Unexamined Patent Publication No. 2000-351252 proposes communication means which can secure communications between a device main body and each additional device regardless of combinations of the additional devices that are loaded to the device main body, when option units as a plurality of additional devices are loaded to an image forming device such as a digital copying machine.

With this, combinations and orders of paper feeding cassettes can be set freely, when loading the paper feeding cassettes to the device main body as the additional devices, for example.

Hereinafter, the communication means depicted in Japanese Unexamined Patent Publication No. 2000-351252 will be described in details. Each of the paper feeding cassettes loaded to the image forming device includes communication means for transmitting and receiving signals to/from an image forming device main body or to/from the other paper feeding cassettes, a first connector, and a second connector.

The communication means transmits a signal that is received from the image forming device main body via the first connector to another paper feeding cassette via the second connector, and transmits a signal that is received from another paper feeding cassette via the second connector to the image forming device main body via the first connector.

Further, the communication means includes a return path for transmitting the signal, which is received from the image forming device main body via the first connector, to the image forming device main body via the first connector without transmitting it to the other paper feeding cassettes via the second connector.

Normally, the polling system is employed when the image forming device main body performs communications with control parts of each of the paper feeding cassettes via such communication means. That is, the image forming device main body transmits a control instruction individually to the control parts by performing polling in order from the control part of the paper feeding cassette loaded on a highest drawer to the control part of the paper feeding cassette loaded on a lowest drawer.

As shown in FIG. 1A, a control part of each paper feeding cassette 7 as the option unit executes drive or stop control of own paper feeding roller 71 and its transporting roller 72 disposed nearby for transporting recording papers. For example, a control part of a paper feeding cassette 7*a* controls a paper feeding roller 71*a* and a transporting roller 72*a*, and a control part of a paper feeding cassette 7*b* controls a paper feeding roller 71*b* and a transporting roller 72*b*.

Each transporting roller 72 is disposed on a common transporting path, so that the control parts of the paper feeding cassettes 7 on an upper-drawer side, i.e., on a downstream side, need to execute drive or stop control of the corresponding transporting rollers 72 in order to transport the recording paper fed from the paper feeding cassette 7 on a lower-drawer side, i.e., from an upstream side.

However, when the communications between the image forming device main body and each paper feeding cassette are performed with the polling system described above, a necessary control signal is transmitted from the image forming device main body to the control parts of each paper feeding cassette in order according to the polling. Thus, the control signal required to be controlled simultaneously by each control part is received with a delay by a length of time that is required for the polling.

For example, in a case where the image forming device main body performs polling from the control part of the paper feeding cassette loaded on the highest drawer towards the control parts of the paper feeding cassettes on the lower drawers in order, there is a delay time of several msec. to several tens of msec. generated until the control signal is transmitted to the paper feeding cassette of the lowest drawer.

Therefore, following issues may be generated because of shift generated in driving timings and stopping timings of each of the transporting rollers 72.

For example, when a stopping control of the transporting roller 72 disposed on the upstream side of the transporting path becomes delayed from a stopping control of the transporting roller 72 that is disposed on the downstream side, a paper may be sagged and bent between the transporting rollers.

Further, when a driving control of the transporting roller 72 disposed on the upstream side of the transporting path becomes delayed from a driving control of the transporting roller 72 that is disposed on the downstream side, a tip side of a recording paper held at the transporting roller 72 on the downstream side is pulled by the transporting roller on the upstream side. This may generate a noise or skew (oblique movement) of the recording paper, which may result in a paper jam or damage to the recording paper.

SUMMARY OF THE INVENTION

In view of the foregoing shortcomings of the conventional technique, it is an object of the present invention to provide an image forming device which can prevent paper jams, damages to recording papers that are being transported, etc., which are caused due to shift in communication timings, while employing communication controls by a polling system to control parts of a plurality of paper feeding cassettes.

A communication control device according to the present invention is an image forming device in which a main body control part for controlling an image forming part is connected, via a serial communication line and a plurality of select signal lines for designating a transmission target, to a plurality of paper feeding control parts that individually control a plurality of paper feeding cassettes that supply recording papers to the image forming part, so that the main control part controls communications with each of the paper feeding control parts by a polling system. The image forming device according to the present invention is characterized in that: the image forming device is constituted to be capable of switching a communication mode between a unicast mode that selects each of the paper feeding control parts individually and a broadcast mode that selects all of the paper feeding control parts based on a select signal transmitted via the select signal lines; the main body control part is structured to switch the communication mode to the broadcast mode after transmitting control data to each of the paper feeding control parts with the unicast mode, at least when stopping a recording paper that is being transported on a paper feeding path or when transporting a recording paper stopped on the paper feeding path, and switched the communication mode to the broadcast mode thereafter; and each of the paper feeding control parts is structured to execute a paper feeding control based on the control data received with the unicast mode, upon detecting the broadcast mode.

BRIEF DESCRIPTION OF THE DRAWINGS

FIG. 5 is an illustration for describing inputs/outputs of select signals of the main control part and the paper feeding control parts;

DESCRIPTION OF THE PREFERRED EMBODIMENTS

Hereinafter, described is an embodiment of a case where an image forming device according to the present invention is applied to a digital copying machine.

Figure 1A:
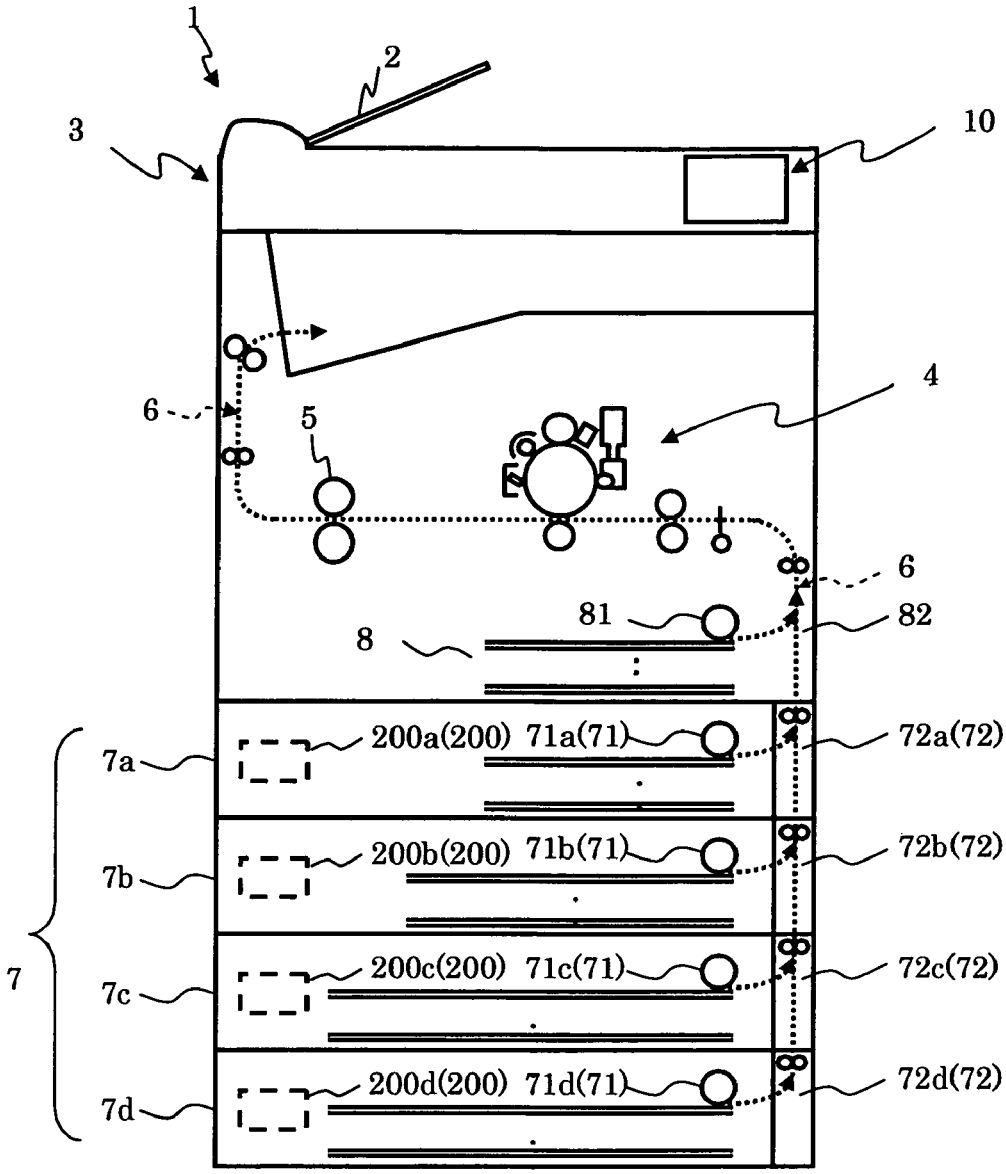
FIG. 1A is an illustration for describing a digital copying machine to which the present invention is applied.

As shown in FIG. 1A, a digital copying machine 1 includes a manuscript loading part 2, an image reading part 3, an image forming part 4, a fixing part 5, a transporting part 6, paper feeding cassettes 7, 8, an operation part 10, and the like.

Image information of a manuscript set on the manuscript loading part 2 is read by the image reading part 3, and it is converted to electronic data to obtain image data. In the image forming part 4, a photoreceptor as an image carrier is exposed based on the image data, and a latent image obtained by exposing the image carrier is developed in a developing part to form a toner image.

A recording paper fed from one of a plurality of paper feeding cassettes 7 (7*a*-7*d*) on which recording papers of different sizes and kinds are housed and a paper feeding cassette 8 provided inside the main body is transported to the image forming part 4 by the transporting part 6, and the toner image is transferred onto the recording paper.

The recording paper onto which the toner image is transferred is heated at the fixing part 5, so that the toner is fused and fixed on the recording paper. Thereafter, the recording paper is discharged.

A plurality of menu setting keys for setting various kinds of copying menus, a start key for starting a printing action, and the like are arranged on the operation part 10.

Figure 1B:
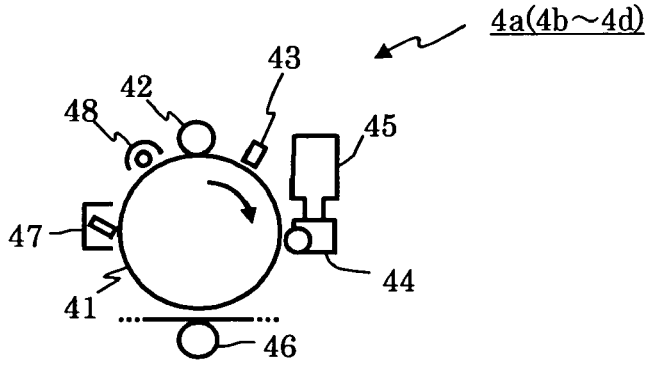
FIG. 1B is an illustration for describing an image forming part.

As shown in FIG. 1B, the image forming part 4 includes a charging member 42, a print head 43, a developing part 44, a transferring part 46, a cleaner part 47, and an eraser lamp 48, which are arranged in order around an image carrier 41.

The image carrier 41 is charged with the charging member 42 that is arranged to be in contact with the image carrier 41, and an electrostatic latent image is formed on the image carrier 41 that is exposed by the print head 43. The developing part 44 electrostatically attaches toner on the electrostatic latent image to be developed into an image, and this toner image is transferred to the recording paper at the transferring part 46.

After the cleaner part 47 removes the toner remained in the image carrier 41 after the transfer, the image carrier 41 is erased by the eraser lamp 48 to remove a residual charge. Then, a following image forming process is repeated.

A toner cartridge 45 as an exchange part is provided so that new toner can be supplied to the developing part 44 when the toner is consumed.

The paper feeding cassettes 7 (7*a*-7*d*) as the option units are provided with respective paper feeding rollers 71 (71*a*-71*d*) for feeding the housed recording papers, transporting rollers 72 (72*a*-72*d*) for transporting the recording papers to the image forming part 4, and paper feeding control parts for controlling the paper feeding rollers 71 and the transporting rollers 72 based on control data transmitted from the control part of the main body.

Each of the paper feeding cassettes 7 (7*a*-7*d*) is structured to be able to piled up on a bottom part of the main body of the digital copying machine 1.

Figure 2:
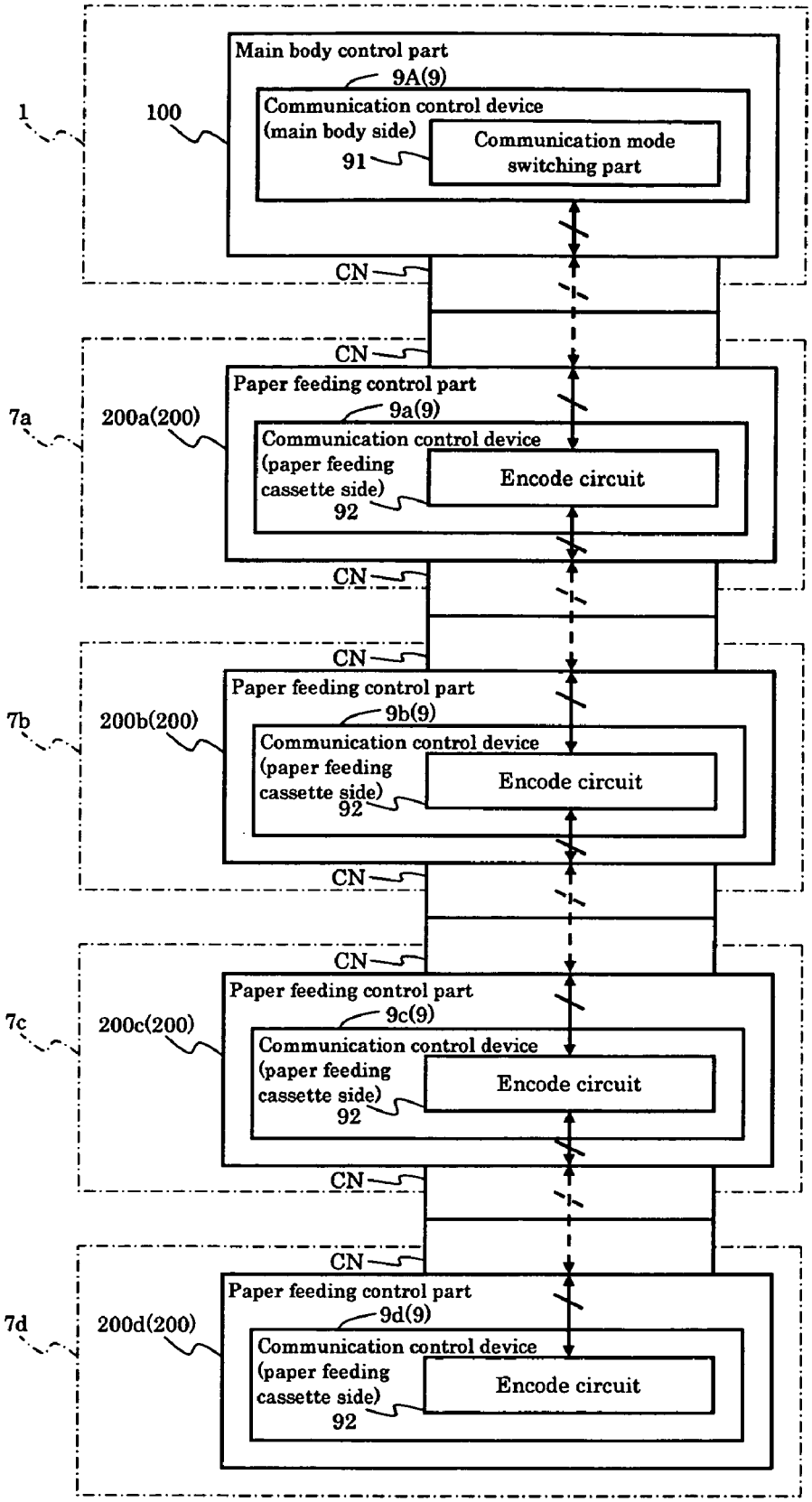
FIG. 2 is a functional block configurational diagram of control parts of the digital copying machine that includes communication control devices.

As shown in FIG. 2, a communication line is connected between the main body of the digital copying machine 1 and the paper feeding cassette 7*a*, between the paper feeding cassette 7*a* and the paper feeding cassette 7*b*, between the paper feeding cassette 7*b* and the paper feeding cassette 7*c*, and between the paper feeding cassette 7*c* and the paper feeding cassette 7*d* via drawer connectors CN, and the control data is communicated between the main body of the digital copying machine 1 and the paper feeding control parts of each paper feeding cassette.

As shown in FIG. 2, a main body control part 100 for controlling each of functional blocks such as the image reading part 3, the image forming part 4, the fixing part 5, and the transporting part 6 is provided to the main body of the digital copying machine 1. A paper feeding control part 200 is provided to each of the plurality of paper feeding cassettes 7 that supply the recording papers to the image forming part 4.

That is, the paper feeding control part 200 includes a paper feeding control part 200*a* for controlling the paper feeding cassette 7*a* on a first drawer, a paper feeding control part 200*b* for controlling the paper feeding cassette 7*b* on a second drawer, a paper feeding control part 200*c* for controlling the paper feeding cassette 7*c* on a third drawer, and a paper feeding control part 200*d* for controlling the paper feeding cassette 7*d* on a fourth drawer.

The main body control part 100 and the paper feeding control parts 200 include: a single or a plurality of CPU(s) on a single or a plurality of control board(s); a ROM to which a control program and the like to be executed by the CPU are stored; a RAM for storing control data; an input/output interface circuit which outputs signals to various kinds of loads as control targets and inputs detected values from various sensors and the like; and so on.

The digital copying machine 1 is so structured that prescribed functions for allowing the digital copying machine 1 to execute image forming processing are achieved by control programs executed by each CPU and by related hardware.

The main body control part 100 and each of the plurality of paper feeding control parts 200*a*-200*d* control transportations of the recording papers by synchronizing with each other. The main body control part 100 and the plurality of paper feeding control parts 200*a*-200*d* are connected via a common communication line, and communication control devices 9 (9A, 9*a*-9*d*) for performing communications between the main body control part 100 and each of the paper feeding control parts 200 are provided to the main body control part 100 and the plurality of the paper feeding control parts 200*a*-200*d*, respectively.

The communication control devices 9 are constituted with the main-body side communication control device 9A provided to the main body control part 100, the paper-feeding side communication control device 9*a* provided to the paper feeding control part 200*a*, the paper-feeding side communication control device 9*b* provided to the paper feeding control part 200*b*, the paper-feeding side communication control device 9*c* provided to the paper feeding control part 200*c*, and the paper-feeding side communication control device 9*d* provided to the paper feeding control part 200*d*, and communications are performed with a polling system from the main-body side communication control device 9A to each of the paper-feeding side communication control devices 9*a*-9*d*.

Figure 3:
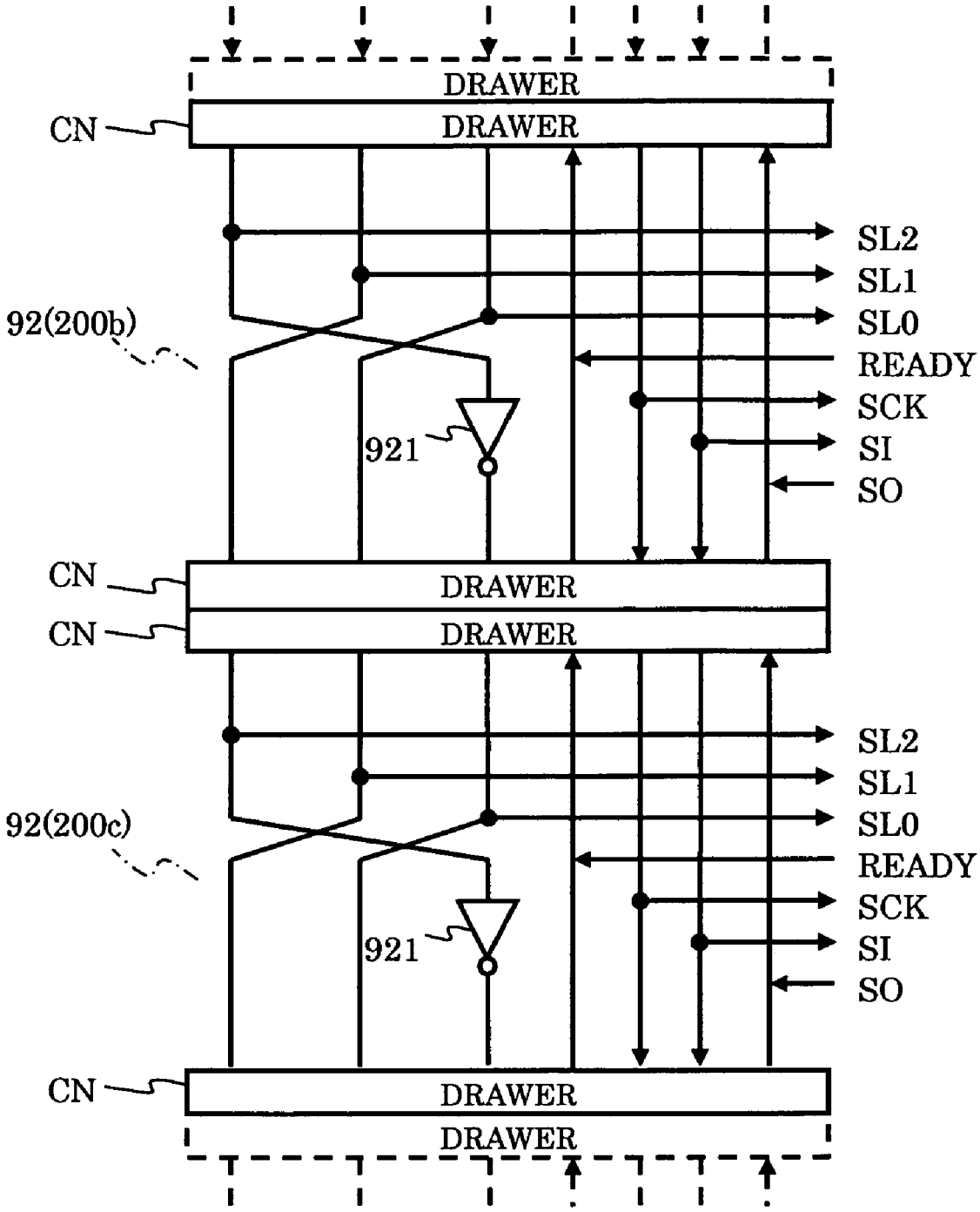
FIG. 3 is an illustration for describing an encode circuit.

As shown in FIG. 3, provided as communication lines are: a pair of bidirectional serial communication lines SI, SO for transmitting/receiving control data between the main body control part 100 and each of the paper feeding control parts 200; three select signal lines SL0, SL1, SL2 with which the main body control part 100 selects one of the paper feeding control parts 200 as a communication target; a ready signal line READY with which the paper feeding control part 200 selected by the select signal line informs the main body control part 100 that it is ready to transmit/receive data; and a clock signal line SCK for transmitting transmission/reception clock from the main body control part 100 to the paper feeding control part 200.

The polling system is a system in which the main control part 100 switches logics of the select signal lines SL0, SL1, and SL2 in a prescribed order via the communication control device 9A to perform polling on each of the paper feeding control parts 200*a*-200*d* successively so as to transmit the necessary control data and receive the control data from each of the paper feeding control parts 200*a*-200*d*.

The main-body side communication control device 9A includes a communication mode switching part 91 which switches, to a broadcast mode, from a unicast mode with which the main body control part 100 transmits the control data individually to each of the paper feeding control parts 200, when it is necessary to control the plurality of paper feeding units simultaneously.

Each of the paper-feeding side communication control devices 9*a*-9*d* includes an encode circuit 92 for encoding select signals that are transmitted via the select signal lines.

As shown in FIG. 3, the encode circuit 92 is constituted with a switching wiring for switching arrangements of the three select signal lines SL0, SL1, SL2, and a single inverter 921 for inverting a logic level of the select signal line SL2.

With the switching wiring, the three select signal lines SL0, SL1, SL2 inputted from the main body control part or the paper feeding control part on the upper drawer via the drawer connectors CN are switched in the following manner before being outputted to the drawer connectors CN to be outputted to the paper feeding control parts on the lower drawers. That is, the select signal line SL2 is switched to SL0, the select signal line SL1 is switched to SL2, and the select signal line SL0 is switched to SL1.

The inverter 921 is interposed on a wiring for switching the select signal line SL2 to the SL0 so as to invert the logic level of the inputted select signal line SL2 and output it as the logic level of the select signal line SL0.

A case of unicast mode transmission will be described. The main body control part switches the logics on the select signal lines SL2, SL1, and SL0, i.e., the select signals, to "100", "110", "111", "011" in order and transmits those via the main-body side communication control device 9A.

As shown in FIG. 5, when the logics on the select signal lines SL2, SL1, and SL0 outputted from the main-body-side communication control device 9A are "100" (see (A) in FIG. 5), "100" is inputted only to the paper feeding control part 200*a* (see (E) in FIG. 5).

Similarly, when the logics on the select signal lines SL2, SL1, and SL0 outputted from the main-body-side communication control device 9A are "110" (see (B) in FIG. 5), "100" is inputted only to the paper feeding control part 200*b* (see (E) in FIG. 5), when the logics on the select signal lines SL2, SL1, and SL0 outputted from the main-body-side communication control device 9A are "111" (see (C) in FIG. 5), "100" is inputted only to the paper feeding control part 200*c* (see (E) in FIG. 5), and when the logics on the select signal lines SL2, SL1, and SL0 outputted from the main-body-side communication control device 9A are "011" (see (D) in FIG. 5), "100" is inputted only to the paper feeding control part 200*d* (see (E) in FIG. 5).

When judging that the logics on the select signal lines SL2, SL1, and SL0 received via the encode circuit 92 and the paper-feeding side communication control devices 9*a*-9*d* are "100", each of the paper feeding control parts 200*a*-200*d* recognizes it as polling for itself, and receives the control data on the serial communication line SI, and outputs the control data to be transmitted onto the serial communication line SO.

There is described a case where the communication mode switching part 91 performs transmission by switching the communication mode from the unicast mode to the broadcast mode. The main body control part 100 performs transmission by switching the logics on the select signal lines SL2, SL1, and SL0 to "010" or "101" via the main-body side communication control device 9A.

As shown in FIG. 5, when the logics on the select signal lines SL2, SL1, SL0 outputted from the main-body side communication control device 9A are "010" (see (F) in FIG. 5), "010" is inputted to the paper feeding control parts 200*a*, 200*c*, and "101" is inputted to the paper feeding control parts 200*b*, 200*d*.

Further, when the logics on the select signal lines SL2, SL1, SL0 outputted from the main-body side communication control device 9A are "101" (see (G) in FIG. 5), "101" is inputted to the paper feeding control parts 200*a*, 200*c*, and "010" is inputted to the paper feeding control parts 200*b*, 200*d*.

When judging that the logics on the select signal lines SL2, SL1, and SL0 received via the encode circuit 92 and the paper-feeding side communication control devices 9*a*-9*d* are "010" or "101", each of the paper feeding control parts 200*a*-200*d* recognizes it as the broadcast mode, and receives the data on the serial communication line SI.

Figure 4:
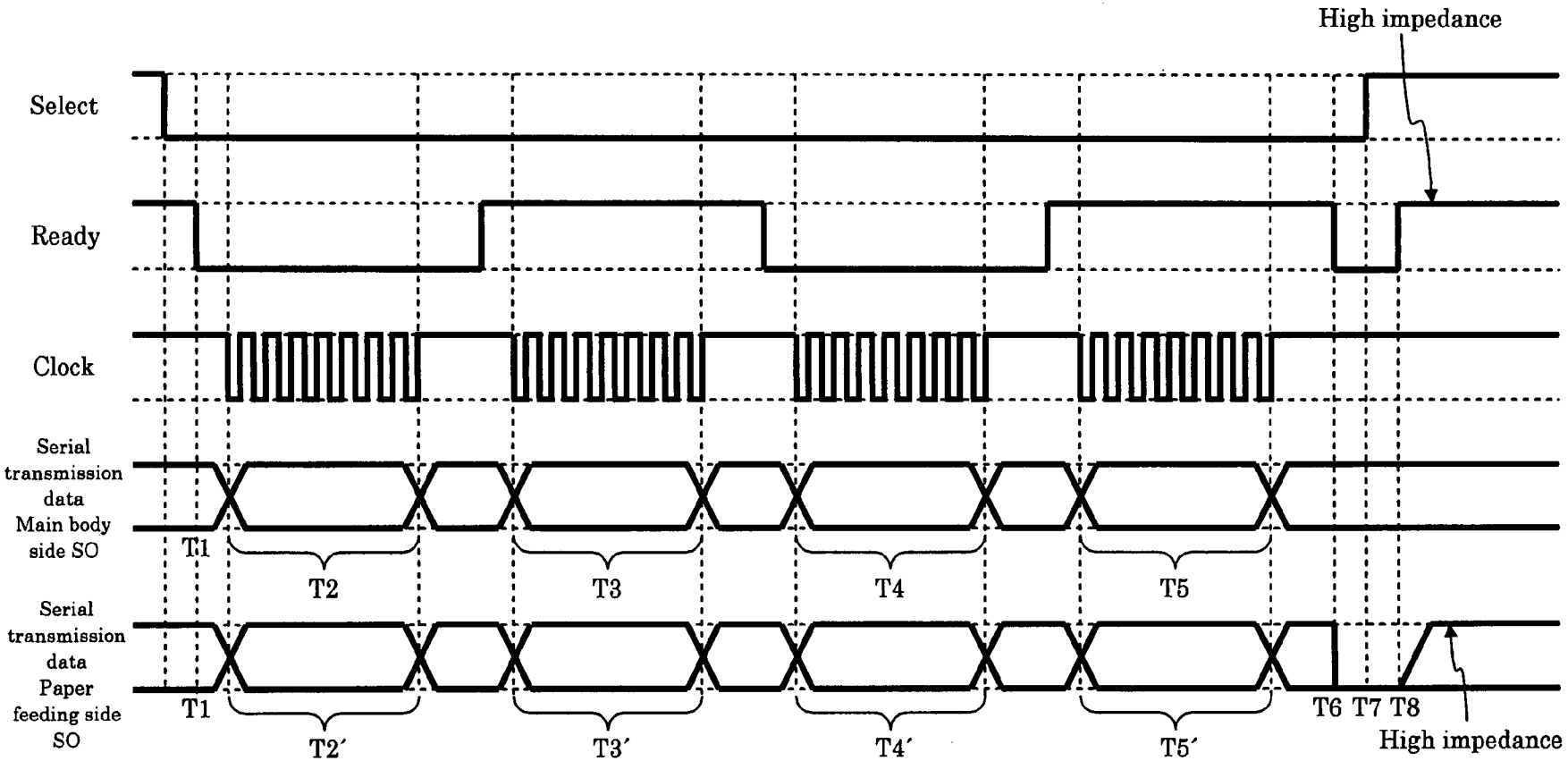
FIG. 4 is a time chart for describing inputs of control data from a main control part to a paper feeding control part.

As a way of example, procedures for transmitting and receiving control data with the unicast mode via the communication lines connected between the main body control part 100 and the paper feeding control part 200*b* on the second drawer will be described by referring to a time chart shown in FIG. 4.

When recognizing that the select signal outputted from the main-body side communication control device 9A is the select signal for the paper-feeding side communication control device 9*b* itself (in the drawing, the select signal is schematically illustrated as a single signal, and illustrated to become a low level (active level) when it is the select signal for the device itself), the paper-feeding side communication control device 9*b* outputs a low-level ready signal to the main-body side communication control device 9A to inform that it is ready to receive control data (T1).

Upon confirming that the ready signal is changed to the low level, the main-body side communication control device 9A outputs the control data to the serial communication line by synchronizing with a clock signal to transmit it to the paper-feeding side communication control device 9*b* (T2).

When receiving the control data of the prescribed byte number (for example, 1 byte in FIG. 4), the paper-feeding side communication control device 9*b* inverts the ready signal to a high level. Upon confirming the inversion of the ready signal, the main-body side communication control device 9A outputs the clock signal again and outputs same control data as that of the previous time to the serial communication line (T3).

The main-body side communication control device 9A transmits the same control data for a total of four times through the above-described sequence by one of the serial communication lines (T2-T5). While the main-body side communication control device 9A is transmitting the control data, the paper-feeding side communication control device 9*b* transmits, to the main-body side communication control device 9A, an answer signal and control data such as size data of the recording paper and data indicating presence of the recording paper via the other serial communication line for a total of four times in the same manner (T2'-T5').

After receiving fourth control data, the paper-feeding side communication control device 9*b* collates the received data to confirm whether or not the reception is completed properly. The paper-feeding side communication control device 9*b* switches the serial communication line on an output side to the low level when confirmed that it is received properly, and switches the serial communication line to the high level when confirmed that it is received improperly so as to inform the reception result of the control data to the main-body side communication control device 9A (T6). FIG. 4 shows a case where the data reception is completed properly.

When judging that the control data is received properly at the paper-feeding side communication control device 9*b*, the main-body side communication control device 9A switches the select signal to a value that does not correspond to any of the paper-feeding side communication control devices (shown as the high level in the drawing) (T7). When confirming that the select signal is being switched, the paper-feeding side communication control device 9*b* switches an output serial communication line and the ready signal to a high impedance state (T8).

When confirming that the output serial communication line and the ready signal are in the high impedance state, the main-body side communication control device 9A starts next transmission, i.e. outputs a select signal that corresponds to the paper-feeding side communication control device 9*c* of the paper feeding cassette on the third drawer.

With the broadcast mode, when the select signal outputted from the main-body side communication control device 9A is recognized as the select signal transmitted with the broadcast mode, only the paper-feeding side communication control device 9*d* of a last drawer outputs the low-level ready signal to the main-body side communication control device 9A (T1). Thereafter, an ending sequence for switching the output-side serial communication line to the low level is executed (T6).

That is, with the broadcast mode, the fact that the select signal transmitted with the broadcast mode is received at the paper-feeding side communication control device 9*d* on the last drawer properly is recognized based on the level of the output-side serial communication line, without transmitting the control data from the main-body side communication control device 9A.

Figure 6:
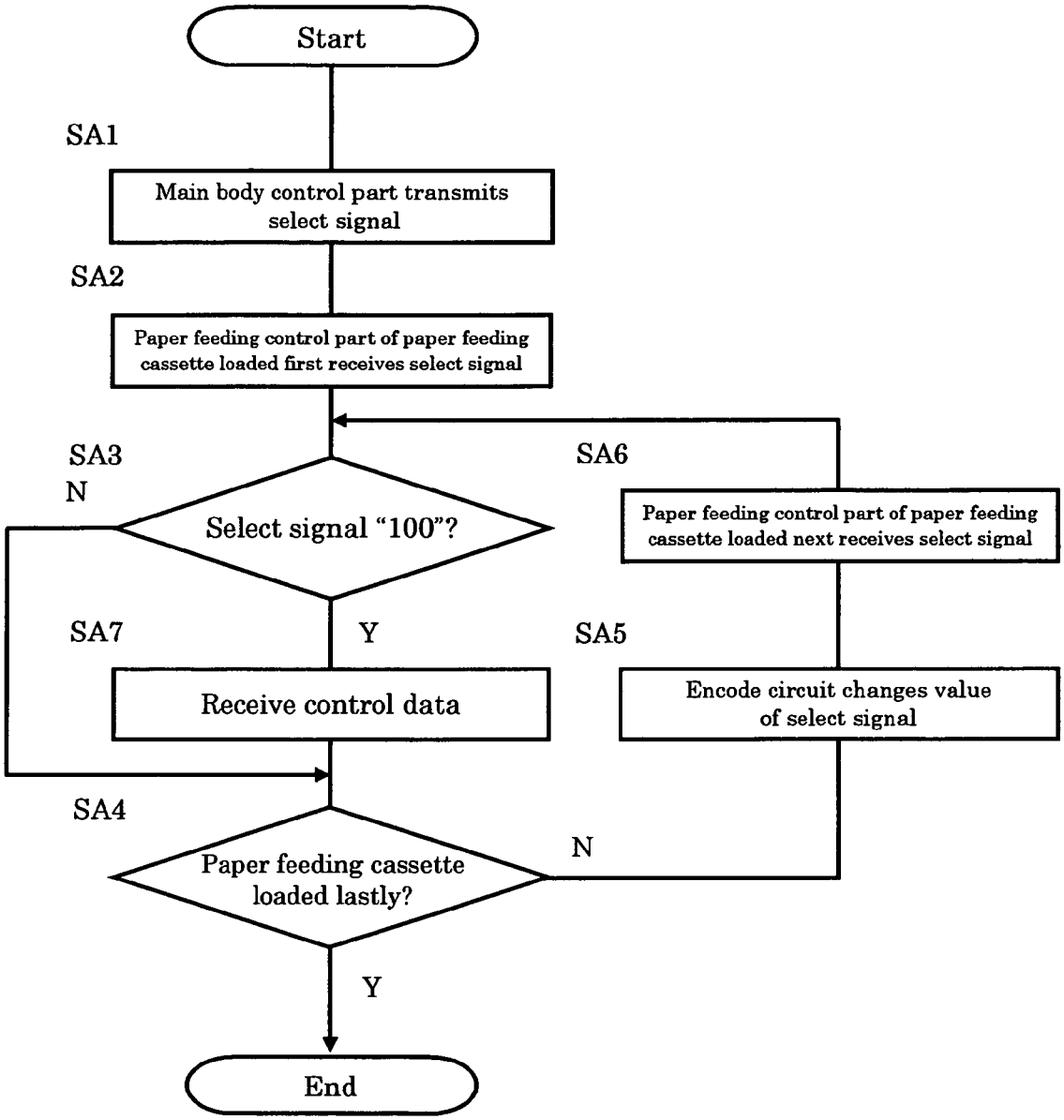
FIG. 6 is a flowchart for describing transmission of control data from the main control part to the paper feeding control parts by polling, when the communication control devices are of a unicast mode.

Hereinafter, there is described receiving processing executed by the paper-feeding side communication control devices 9*a*-9*d* when the control data is transmitted from the main-body side communication control device 9A with the unicast mode, by referring to a flowchart shown in FIG. 6.

When the main-body side communication control device 9A transmits the select signal "111" to the paper feeding control part 200*c* on the third drawer (SA1), the paper-feeding side communication control device 9*a* on the highest drawer judges that the received select signal is not the select signal "100" for itself (SA2, SA3). Thus, the paper-feeding side communication control device 9*a* does not execute the control data receiving processing.

Before the select signal reaches the paper-feeding side communication control device 9*d* on the lowest drawer (SA4), the select signal is converted from "111" to "110" by the encode circuit 92 that is mounted to the paper-feeding side communication control device 9*a* on the highest drawer (SA5). The paper-feeding side communication control device 9*b* on the second drawer upon receiving the converted select signal also judges that the received select signal is not the select signal "100" for itself (SA6, SA3). Thus, the paper-feeding side communication control device 9*b* does not execute the control data receiving processing.

Before the select signal reaches the paper-feeding side communication control device 9*d* on the lowest drawer (SA4), the select signal is converted from "110" to "100" by the encode circuit 92 that is mounted to the paper-feeding side communication control device 9*b* on the second drawer (SA5). The paper-feeding side communication control device 9*c* on the third drawer upon receiving the converted select signal judges that the received select signal is the select signal "100" for itself (SA6, SA3). Thus, the paper-feeding side communication control device 9*c* executes the control data receiving processing and stores the received control data (SA7).

Before the select signal reaches the paper-feeding side communication control device 9*d* on the lowest drawer (SA4), the select signal is converted from "100" to "000" by the encode circuit 92 that is mounted to the paper-feeding side communication control device 9*c* on the third drawer (SA5). The paper-feeding side communication control device 9*d* on the lowest drawer upon receiving the converted select signal judges that the received select signal is not the select signal "100" for itself (SA6, SA3). Thus, the paper-feeding side communication control device 9*d* does not execute the control data receiving processing.

That is, when the select signal for the paper feeding control part 200*c* on the third drawer outputted from the main-body side communication control device 9A is converted in order by the encode circuits 92 of each paper feeding drawer and received at the paper-feeding side communication control device 9*d* on the lowest drawer (SA4), it is switched by the main-body side communication control device 9A to the select signal for the paper feeding control part 200*c* of a next paper feeding drawer. Then, same operations are repeated.

Each of the paper-feeding side communication control devices 9*a*-9*d* transmits and receives the control data to/from the main-body side communication control device 9A, when the logic of the select signal is a logic that is to be received by itself.

When the digital copying machine 1 is started up, it is set as the unicast mode by the communication mode switching part 91. At the time of startup, the main-body side communication control device 9A switches and outputs the select signal successively from the paper feeding control part on the highest drawer to the paper feeding control part on the lowest drawer. The main-body side communication control device 9A recognizes the paper feeding control part 200, which is confirmed to have responded by corresponding to each select signal, as being loaded to the device main body, while recognizing the paper feeding control part 200, which is not confirmed to have responded by corresponding to each select signal, as not being loaded to the device main body or as having a fault.

Then, when the main-body side communication control device 9A transmits, to the paper feeding control part 200 that is confirmed to be loaded to the device main body, structural data of the paper feeding cassette indicating which drawer of the paper feeding cassette it belongs to, the paper feeding control part 200 that has received the structural data of the paper feeding cassette recognizes which drawer of the paper feeding cassette it belongs to.

The control data transmitted individually from the main body control part 100, via the serial communication line SI, to each of the paper feeding control parts 200 includes a paper feeding instruction for driving the paper feeding roller, a transporting instruction for driving the transporting roller, and discrimination flags as discrimination data for designating execution timing of each instruction, and the control data including those discrimination flags is allocated to a prescribed area of a transmission frame. It is noted that "control instruction" depicted hereinafter means the same as the control data.

The discrimination flag is data for discriminating whether to execute the each instruction upon detecting the broadcast mode or to execute it immediately when it is received with the unicast mode.

Each of the paper feeding control parts 200 stores the control instruction received with the unicast mode to the RAM. When the discrimination flag is "0" (reset state), for example, each of the paper feeding control parts 200 executes the control instruction immediately after receiving it. When the discrimination flag is "1" (set state), each of the paper feeding control parts 200 withholds immediate execution of the control instruction after the reception, and executes it at the timing of receiving the select signal with the broadcast mode.

Figure 7:
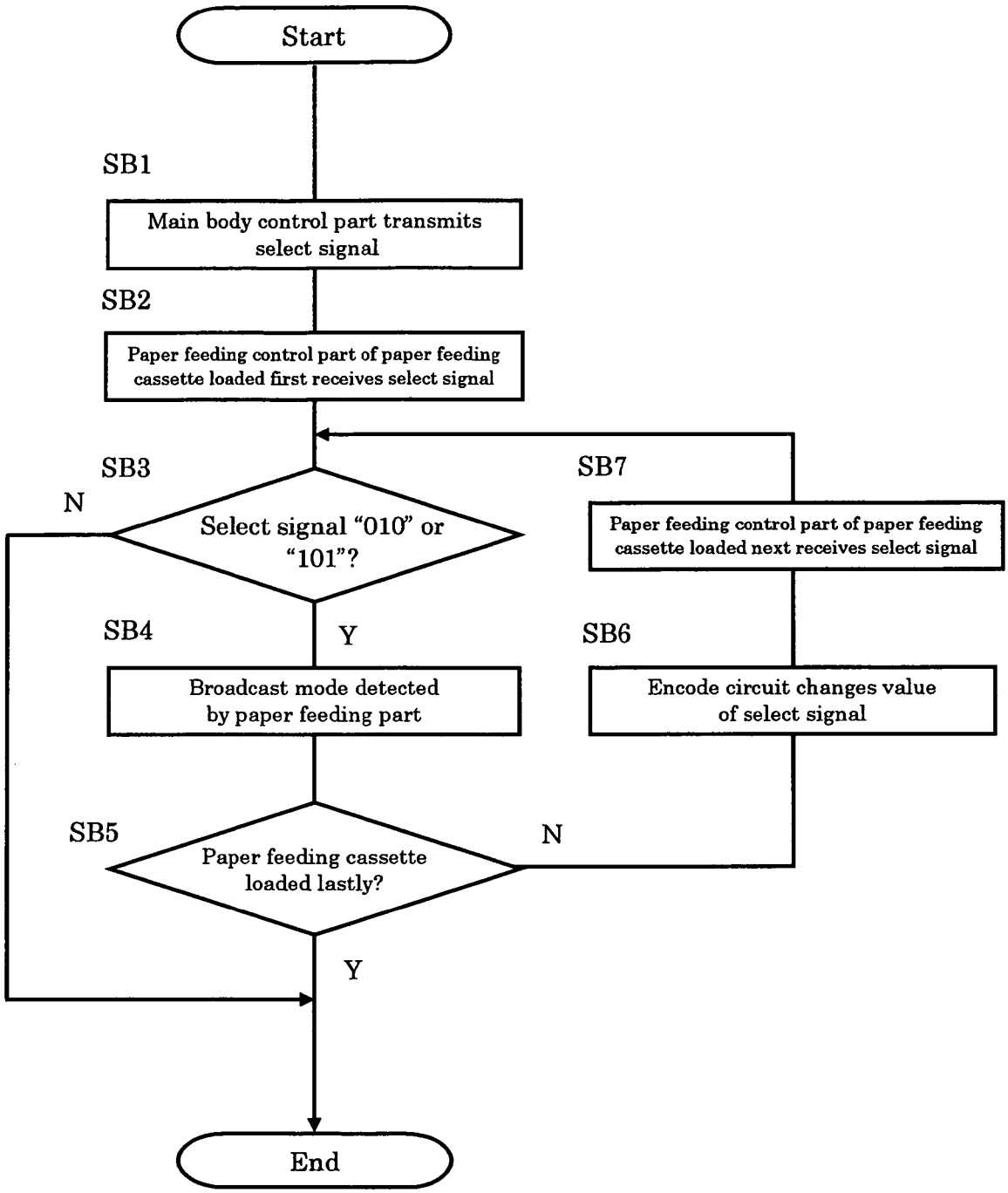
FIG. 7 is a flowchart for describing detection of a broadcast mode by the communication control device.
Figure 8:
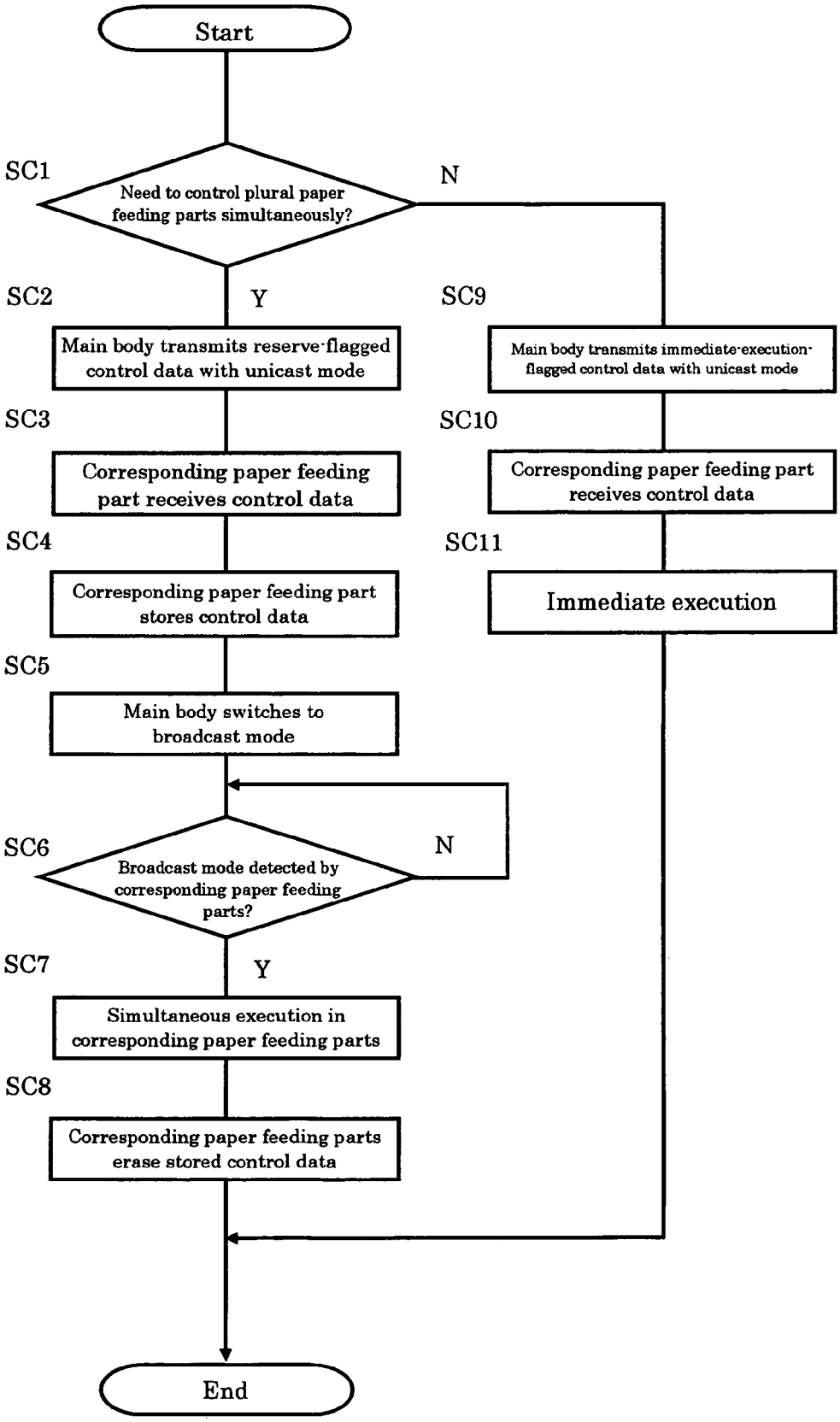
FIG. 8 is a flowchart for describing that data transmitted with the unicast mode is executed upon detecting the broadcast mode.

Hereinafter, there is described receiving processing executed by the paper-feeding side communication control devices 9*a*-9*d* with the broadcast mode, by referring to a flowchart shown in FIG. 7.

First, the main body control part 100 switches the communication mode from the unicast mode to the broadcast mode via the communication mode switching part 91. Thereafter, the main body control part 100 performs transmission by switching the logics on the select signal lines SL2, SL1, and SL0 to "010" or "101" via the main-body side communication control device 9A (SB1).

The paper feeding control part 200*a* that controls the paper feeding cassette 7*a* on the highest drawer receives the select signal (SB2). Since the logic of the select signal is "010" (SB3), the paper feeding control part 200*a* recognizes it as the broadcast mode (SB4).

Since the paper feeding cassette 7*a* is not the lowest-drawer paper feeding cassette 7 (SB5), the logic of the select signal is changed from "010" to "101" by the encode circuit 92 of the paper-feeding side communication control device 9*a* (SB6).

The paper feeding control part 200*b* that controls the paper feeding cassette 7*b* on the second drawer receives the select signal (SB7). Since the logic of the select signal is "101" (SB3), the paper feeding control part 200*b* detects that it is the broadcast mode (SB4).

Since the paper feeding cassette 7*b* is not the lowest-drawer paper feeding cassette 7 (SB5), the logic of the select signal is changed from "101" to "010" by the encode circuit 92 of the paper-feeding side communication control device 9*b* (SB6).

The paper feeding control part 200*c* that controls the paper feeding cassette 7*c* on the third drawer receives the select signal (SB7). Since the logic of the select signal is "010" (SB3), the paper feeding control part 200*c* detects that it is the broadcast mode (SB4).

Since the paper feeding cassette 7*c* is not the lowest-drawer paper feeding cassette 7 (SB5), the logic of the select signal is changed from "010" to "101" by the encode circuit 92 of the paper-feeding side communication control device 9*c* (SB6).

The paper feeding control part 200*d* that controls the paper feeding cassette 7*d* on the lowest drawer receives the select signal (SB7). Since the logic of the select signal is "101" (SB3), the paper feeding control part 200*d* detects that it is the broadcast mode (SB4).

The paper feeding cassette 7*d* on the lowest drawer is the paper feeding cassette that is loaded at the end, so that it executes the ending sequence described above (SB5).

When recognizing that it is the broadcast mode based on the logic of the select signal, the paper-feeding side communication control devices 9*a*-9*d* simultaneously execute each of the control instructions which are received with the unicast mode and whose discrimination flags stored in the RAM are "1" (set state).

Thus, the control instruction is executed simultaneously by the paper-feeding side communication control devices 9*a*-9*d* at the timing at which the logic of the select signal is recognized as the broadcast mode. Therefore, there is no time lag generated in the control timings of the transporting rollers and the like, which are driven or stopped by the respective paper feeding control parts 200.

Further, it is unnecessary for the main body control part 100 to transmit the control instruction with the broadcast mode, so that there is no delay in the time for transmitting the control instruction.

The control instructions required to be switched to the broadcast mode, e.g., a control instruction that may cause a paper jam because the transporting roller of the paper feeding cassette 7 on the upstream side (lower drawer) of a certain paper feeding cassette 7 is driven when the transporting roller thereof is stopped, and a control instruction that may cause a paper jam because the transporting roller of the paper feeding cassette 7 on the downstream side (higher drawer) of a certain paper feeding cassette 7 is stopped when the transporting roller thereof is driven, are registered to the ROM of the main body control part 100 in advance.

When transmitting the control instruction that is registered to the ROM, the main body control part 100 switches the communication mode to the broadcast mode after transmitting the control instruction with the unicast mode.

Hereinafter, there is described an operation for switching the communication mode to the broadcast mode after transmitting the control instruction with the unicast mode, based on a flowchart show in FIG. 9.

For example, when the transporting roller 72*c* is to be stopped while the recording paper is being fed from the third-drawer paper feeding cassette 7*c*, not only the transporting roller 72*c* of the paper feeding cassette 7*c* but also the transporting rollers 72*a*, 72*b* of the paper feeding cassettes 7*a*, 7*b* on the higher drawers thereof are required to be stopped at the same time in order to prevent damages to the recording papers and a paper jam caused due to shift in the communication timing.

That is, when it is necessary to control the transporting rollers simultaneously with the plurality of paper feeding control parts 200 (SC1), the main body control part 100 transmits the control instruction whose discrimination flag is set to "1" with the unicast mode, i.e., an instruction for stopping the transporting rollers (SC2).

Upon receiving the control instruction (SC3), each of the paper feeding control parts 200 stores the control instruction to the RAM (SC4).

The main body control part 100 switches the communication mode from the unicast mode to the broadcast mode via the communication mode switching part 91, and transmits the select signal "010" or "101" to each of the paper feeding control parts 200 (SC5).

Each of the paper feeding control parts 200 recognizes that it is the broadcast mode based on the logic of the select signal (SC6), executes the control instruction stored to the RAM, i.e., stops the transporting roller (SC7), and erases the control data stored to the RAM thereafter (SC8).

Thereby, each transporting roller is stopped simultaneously by the paper feeding control parts 200*a*, 200*b*, and 200*c* which control the paper feeding cassettes on the highest, second, and third drawers respectively.

In the meantime, when it is unnecessary to stop the transporting rollers simultaneously by the plurality of paper feeding control parts 200 in step SC1, the main body control part 100 transmits the control instruction whose discrimination flag is reset to "0" with the unicast mode, i.e., transmits the instruction for stopping the transporting roller (SC9).

When the corresponding paper feeding control part receives the control instruction (SC10), the control instruction is executed immediately, i.e., the transporting roller thereof is stopped immediately (SC11).

In the above, the control for stopping the transporting rollers simultaneously has been described. The same applies for the control for driving the transporting rollers simultaneously.

Another embodiment will be described hereinafter. The embodiment above has been described by referring to the case using the paper feeding cassettes as the option units that can be attached and detached to/from the main body, in which the control parts thereof are connected via the communication control devices 9. However, the option units are not limited only to the paper feeding cassettes. For example, the present invention can be applied to cases where the option units are manual feeding parts, document feeders, finishers, or the like.

The embodiment above has been described by referring to the case where the communication control devices 9 are applied to the digital copying machine 1 as the image forming device. However, a device to which the communication control devices 9 are to be applied is not limited only to the digital copying machine 1, but may be other devices as well. Examples of such devices are a tandem-system color digital copying machine, a printer, a fax machine, a composite machine, and the like.

While the preferred embodiments have been described above, such description is for illustrative purpose only and not intended to limit the scope of the present invention. It is to be understood that various modifications may be made in the specific structures of each part without departing from the spirit and scope of the appended claims.

What is claimed is:

1. An image forming device, comprising:

a main body control part for controlling an image forming part;

a plurality of additional equipment control parts that can be attached and detached to/from the image forming part;

a serial communication line and a plurality of select signal lines for designating a transmission target, which connect the main control part to the plurality of additional equipment control parts; and a communication mode switching part constituted to be capable of switching a communication mode between a unicast mode that selects each of the additional equipment control parts individually and a broadcast mode that selects all of the additional equipment control parts based on select signals transmitted via the select signal lines, the communication mode switching part, when it is necessary to control each of the additional equipment control parts simultaneously, switching the communication mode for each of the additional equipment control parts to the unicast mode, and switching the communication mode to the broadcast mode after control data transmitted with the unicast mode is transmitted individually to each of the additional equipment control parts via the serial communication line.

2. The image forming device according to claim 1, wherein each of the additional equipment control parts executes a control based on the control data received with the unicast mode, upon detecting the broadcast mode.

3. The image forming device according to claim 1, wherein the control data transmitted with the unicast mode includes discrimination data for discriminating whether to execute the control data upon detecting the broadcast mode or to execute it immediately.

4. An image forming device, comprising:

a main body control part for controlling an image forming part;

a plurality of paper feeding control parts which individually control a plurality of paper feeding cassettes that supply recording papers to the image forming part;

a serial communication line and a plurality of select signal lines for designating a transmission target, which connect the image forming part to the plurality of paper feeding control parts; and a communication mode switching part constituted to be capable of switching a communication mode between a unicast mode that selects each of the paper feeding control parts individually and a broadcast mode that selects all of the paper feeding control parts based on select signals transmitted via the select signal lines, the communication mode switching part, when it is necessary to control each of the paper feeding control parts simultaneously, switching the communication mode for each of the paper feeding control parts to the unicast mode, and switching the communication mode to the broadcast mode after control data transmitted with the unicast mode is transmitted individually to each of the paper feeding control parts via the serial communication line.

5. The image forming device according to claim 4, wherein each of the paper feeding control parts executes a control based on the control data received with the unicast mode, upon detecting the broadcast mode.

6. The image forming device according to claim 4, wherein the control data transmitted with the unicast mode includes discrimination data for discriminating whether to execute the control data upon detecting the broadcast mode or to execute it immediately.

7. The image forming device according to claim 4, wherein:

the main body control part switches the communication mode to the unicast mode by the communication mode switching part to transmit the control data to each of the paper feeding control parts at least when stopping a recording paper that is being transported on a paper feeding path or when transporting a recording paper stopped on the paper feeding path, and switches the communication mode to the broadcast mode thereafter; and each of the paper feeding control parts executes a paper feeding control based on the control data received with the unicast mode, upon detecting the broadcast mode.

* * * * *